US006821213B1

(12) United States Patent
Ko

(10) Patent No.: US 6,821,213 B1
(45) Date of Patent: Nov. 23, 2004

(54) DEVICE FOR TRAINING THE STANCE OF A GOLFER

(76) Inventor: Chin-Ho Ko, No. 69-1, Hsia Li Rd. Hsien Hsi Hsiang, Chang Hua Hsien (TW)

( * ) Notice: Subject to any disclaimer, the term of this patent is extended or adjusted under 35 U.S.C. 154(b) by 0 days.

(21) Appl. No.: 10/628,053

(22) Filed: Jul. 28, 2003

(51) Int. Cl.[7] ..... A63B 69/36
(52) U.S. Cl. ..... 473/257
(58) Field of Search ..... 473/219, 226, 473/257, 258, 259, 260, 261, 266

(56) References Cited

U.S. PATENT DOCUMENTS 3,583,707 A * 6/1971 Fujimoto ..... 473/259
4,852,881 A * 8/1989 Bellagamba et al. ..... 473/216
4,900,030 A * 2/1990 Houtz ..... 473/258
4,919,432 A * 4/1990 Coggins et al. ..... 473/259
4,928,974 A * 5/1990 VanKirk ..... 473/259
5,330,192 A * 7/1994 Amos ..... 473/259
5,439,225 A * 8/1995 Gvoich et al. ..... 473/223
5,816,932 A * 10/1998 Alexander ..... 473/259
5,984,798 A * 11/1999 Gilmour ..... 473/221

* cited by examiner

*Primary Examiner*—Gregory Vidovich
*Assistant Examiner*—Nini F. Legesse
(74) *Attorney, Agent, or Firm*—Harrison & Egbert

(57) ABSTRACT

A golf training device includes an arcuate track and a support frame for supporting the arcuate track at an angle on a surface to facilitate the training of the ball-hitting posture of a golfer.

2 Claims, 9 Drawing Sheets

DEVICE FOR TRAINING THE STANCE OF A GOLFER

RELATED U.S. APPLICATIONS

Not applicable.

STATEMENT REGARDING FEDERALLY SPONSORED RESEARCH DEVELOPMENT

Not applicable.

REFERENCE TO MICROFICHE APPENDIX

Not applicable.

FIELD OF THE INVENTION

The present invention relates generally to a training device of golf, and more particularly to a device for training the ball-hitting posture of a golfer.

BACKGROUND OF THE INVENTION

The conventional golf training devices are generally defective in design in that they can not be used to train the stance of a golfer in such a way that the golfer assumes a correct bodily posture to hit the golf ball with a golf club. In order to be a skillful golfer, a golfer, especially a beginner, must practice repeatedly for the purpose of acquiring proficiency in the ball-hitting posture.

BRIEF SUMMARY OF THE INVENTION

The primary objective of the present invention is to provide a device which is exclusively designed for training the ball-hitting posture of a golfer.

In keeping with the principle of the present invention, the foregoing objective of the present invention is attained by a training device, which comprises an arcuate track and a support frame for supporting the arcuate track on a surface. The arcuate track is provided in one longitudinal side with a guide wall for guiding the golf club head to move in a path.

The features and the advantages of the present invention will be more readily understood upon a thoughtful deliberation of the following detailed description of the present invention with reference to the accompanying drawings.

DETAILED DESCRIPTION OF THE INVENTION

Figure 1:
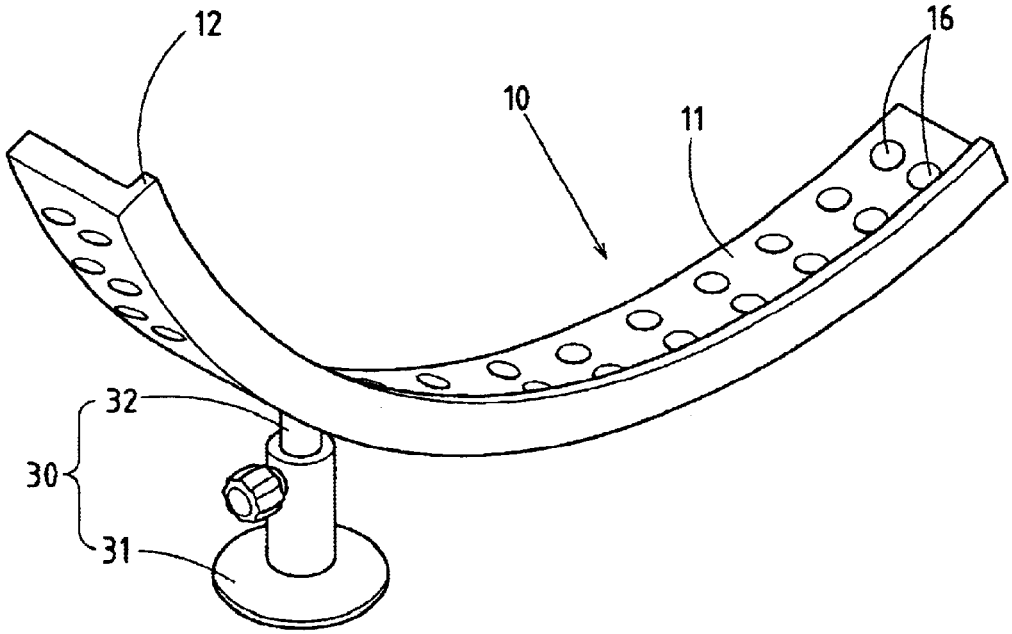
FIG. 1 shows a perspective view of the present invention.
Figure 2:
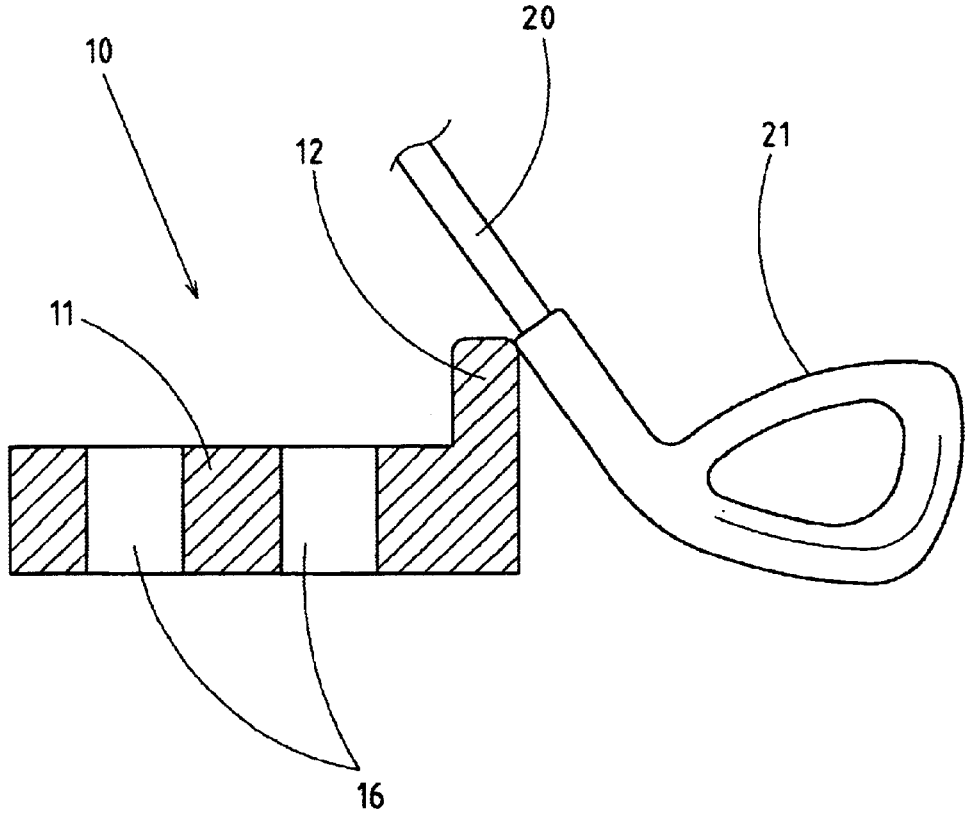
FIG. 2 shows a cross-sectional view of the arcuate track of the present invention.
Figure 3:
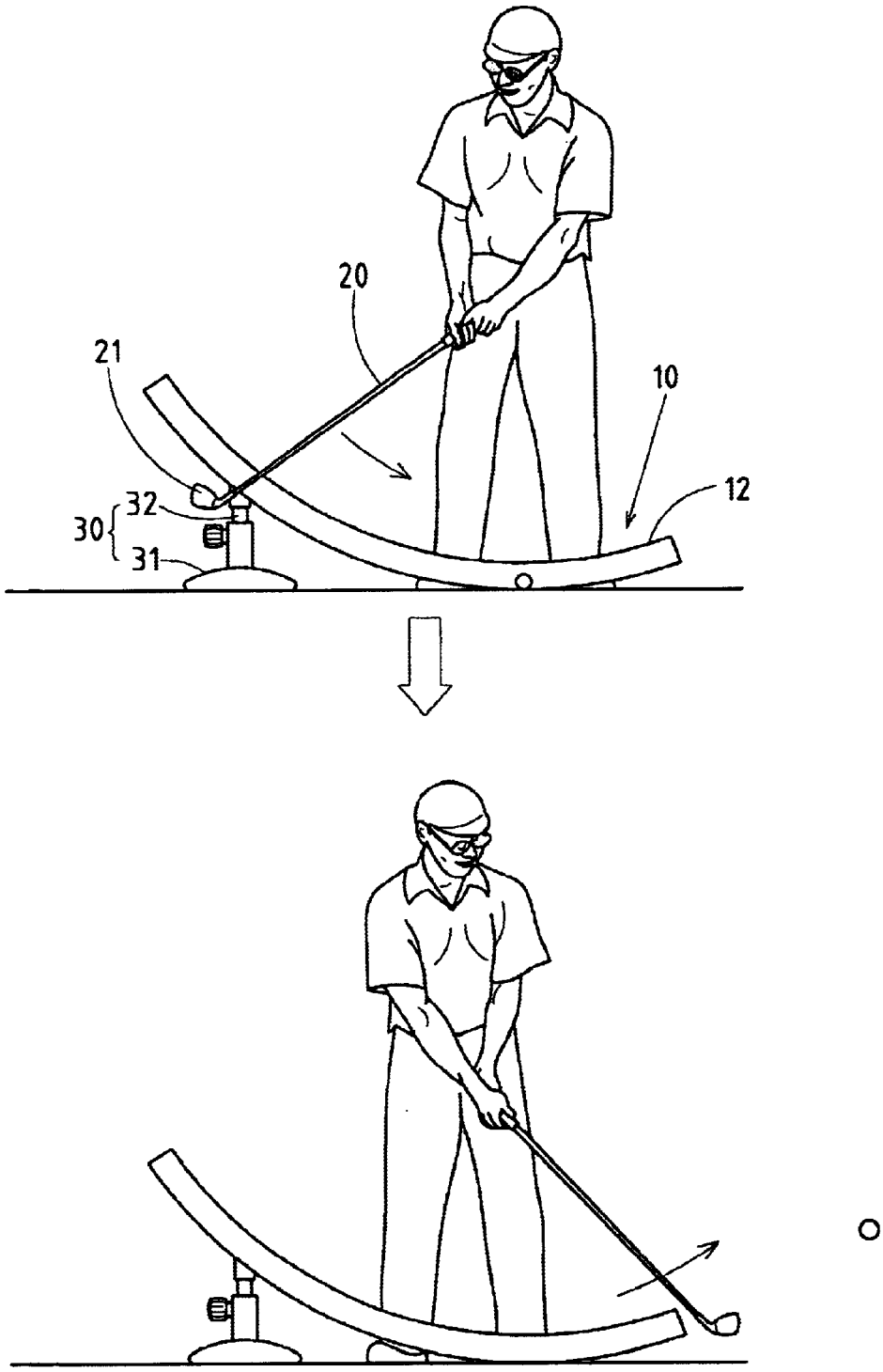
FIG. 3 shows a schematic view of the present invention at work.
Figure 4:
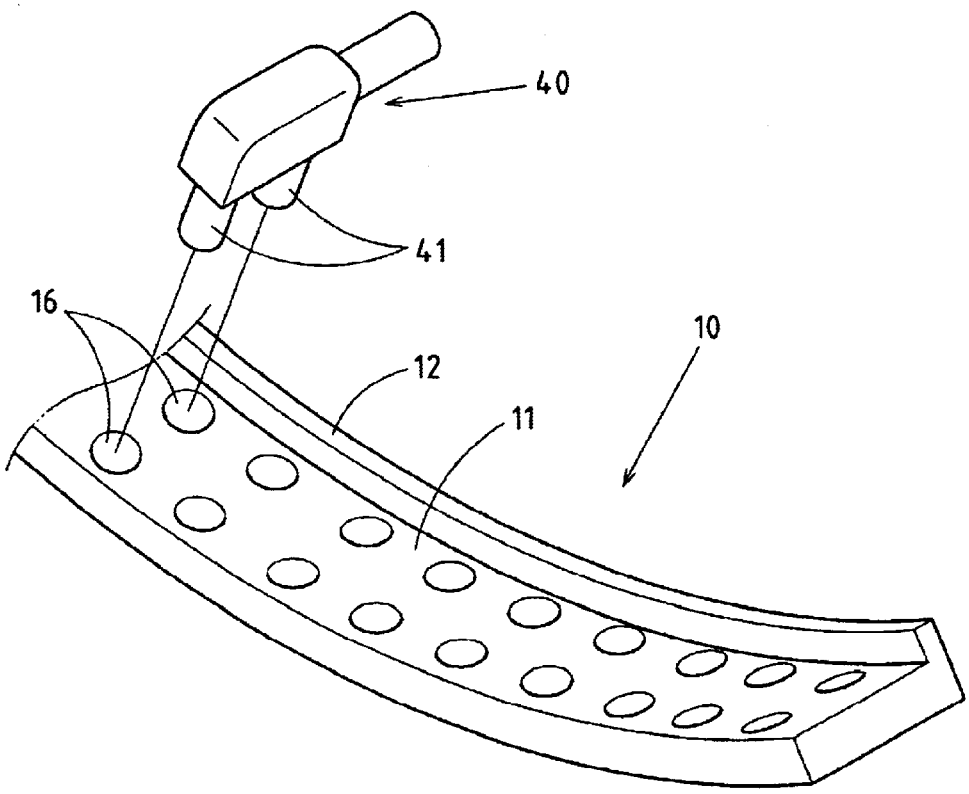
FIG. 4 shows a partial exploded perspective view of a second preferred embodiment of the present invention.

As shown in FIGS. 1 and 2, a training device embodied in the present invention comprises an arcuate track 10 and a support frame 30 which is used to support the arcuate track 10 on a surface. The arcuate track 10 has a track surface 11 corresponding in length to a maximum range in which the golf club head swings in the course of driving off a golf ball. The track surface 11 is provided in one longitudinal side with a guide wall 12 for guiding the moving of the head 21 of a golf club 20. The arcuate track 10 is integrally made.

Figure 7:
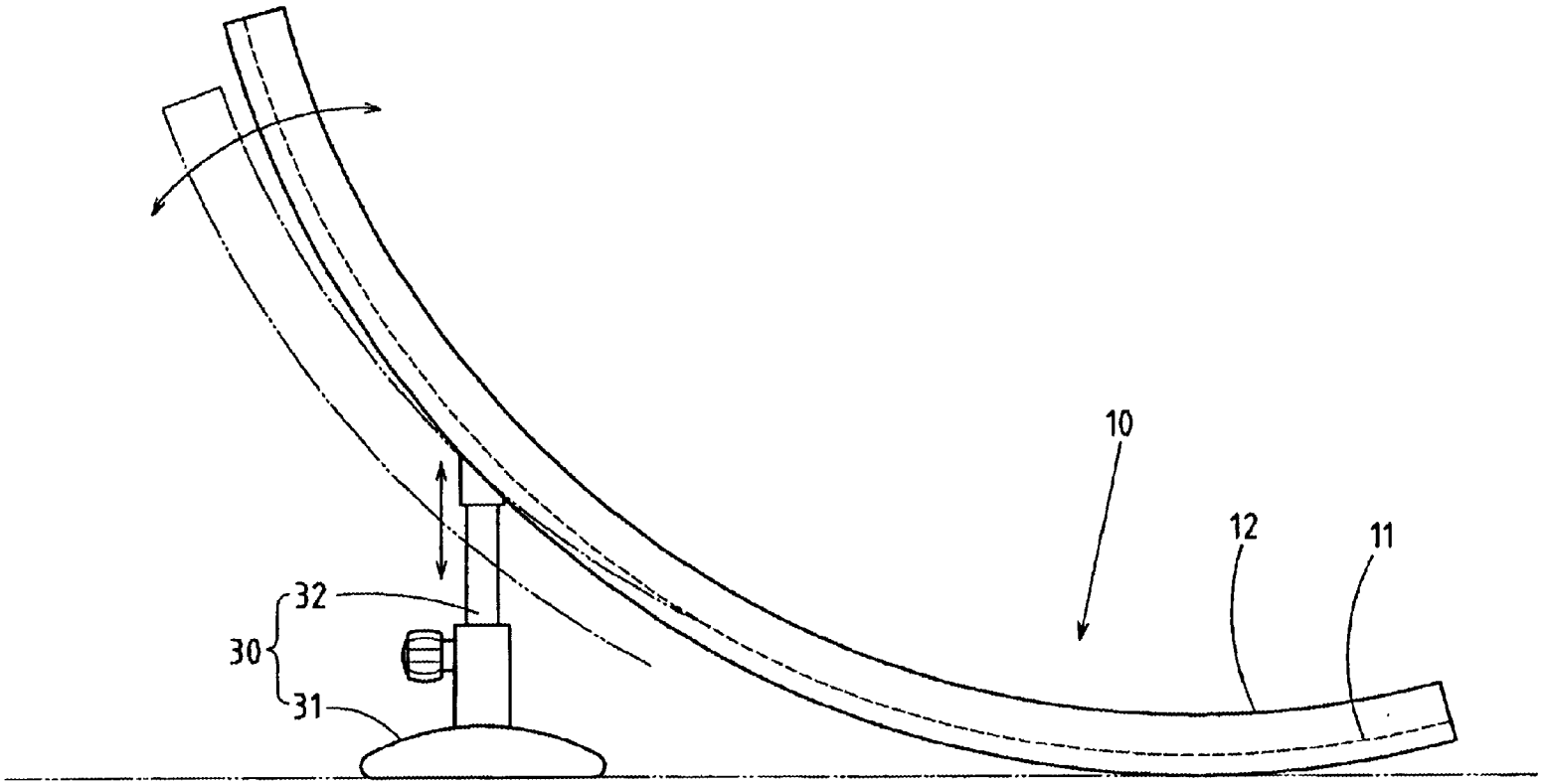
FIG. 7 shows a schematic view of the support frame of the present invention at work.
Figure 8:
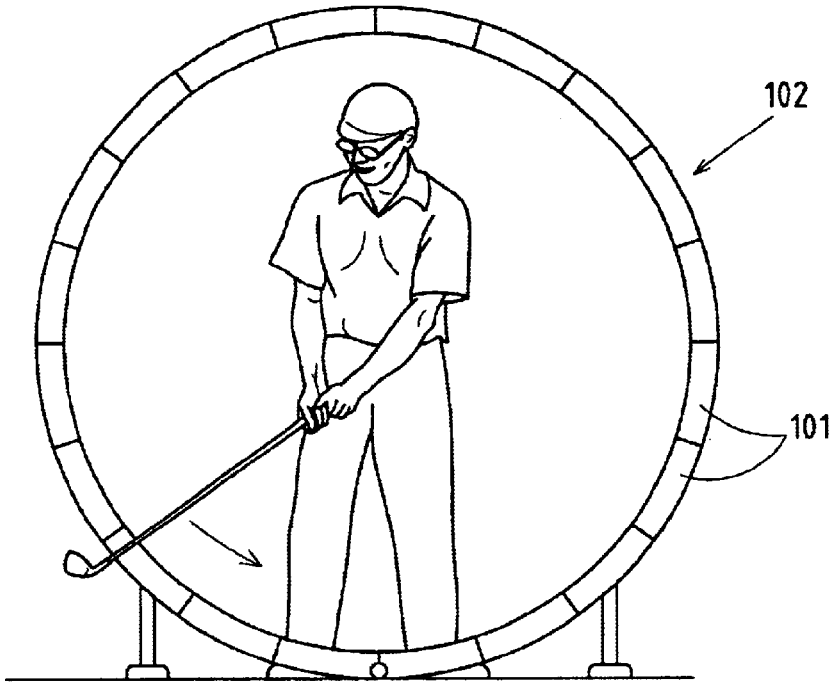
FIG. 8 shows a schematic view of a fourth preferred embodiment of the present invention at work.
Figure 9:
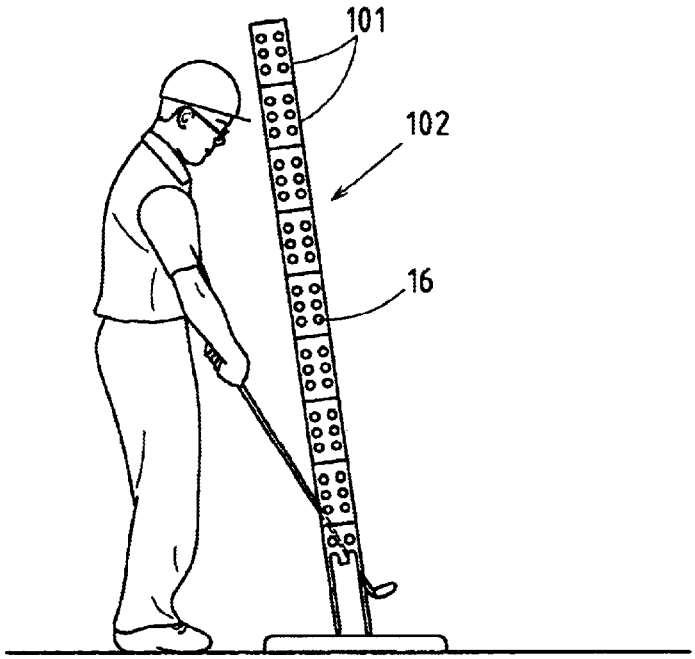
FIG. 9 shows a schematic view taken from another angle of the fourth preferred embodiment of the present invention.

The support frame 30 comprises a base 31, and an expandable rod 32 by means of which the inclination of the arcuate track 10 is adjusted, as illustrated in FIG. 7.

Figure 5:
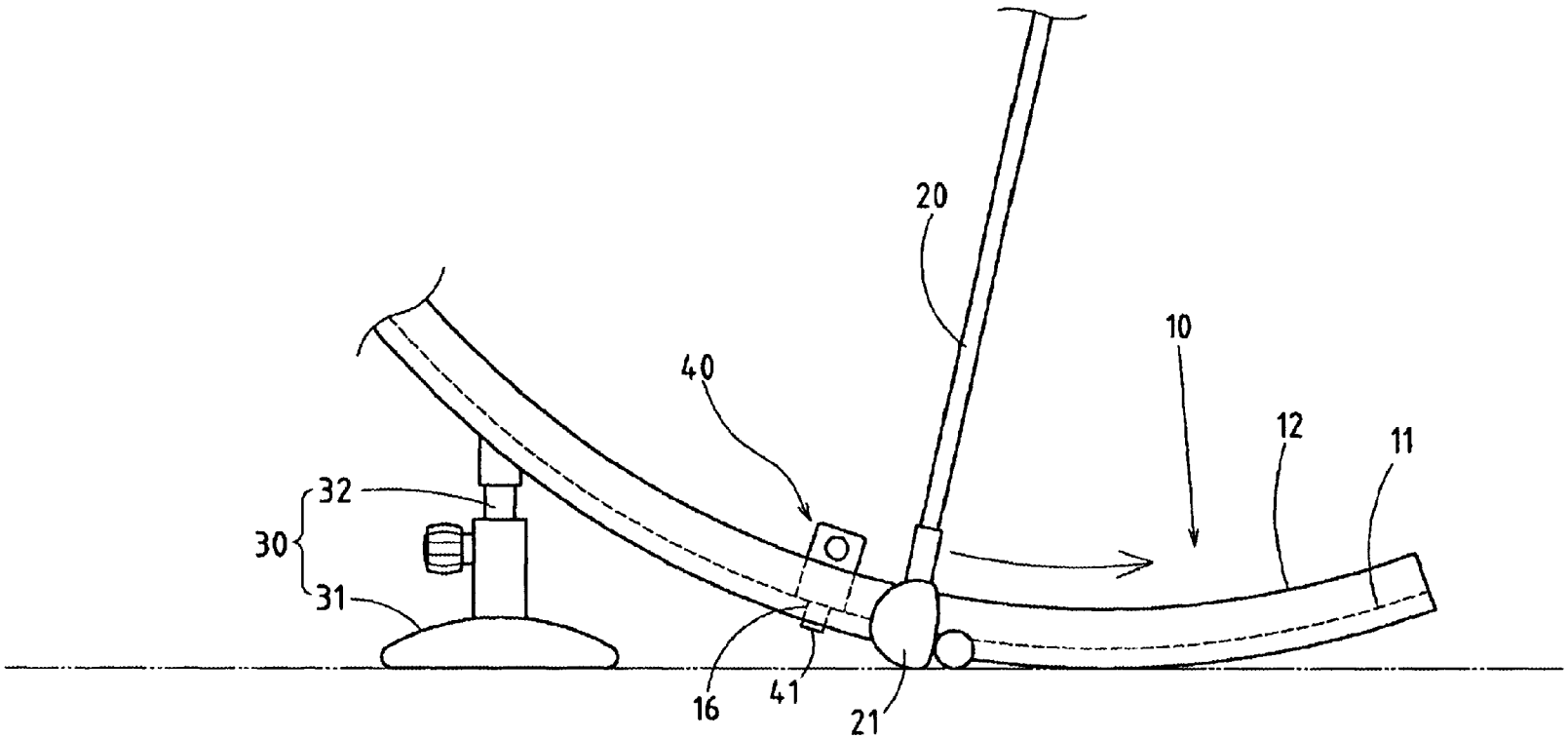
FIG. 5 shows a schematic view of the second preferred embodiment of the present invention at work.

The arcuate track 10 is provided with a series of locating holes 16, which are used to accommodate legs 41 of a defining piece 40. The defining piece 40 is used to define the range of movement of the head 21 of the golf club 20 along the arcuate track 10, as illustrated in FIG. 5.

Figure 6:
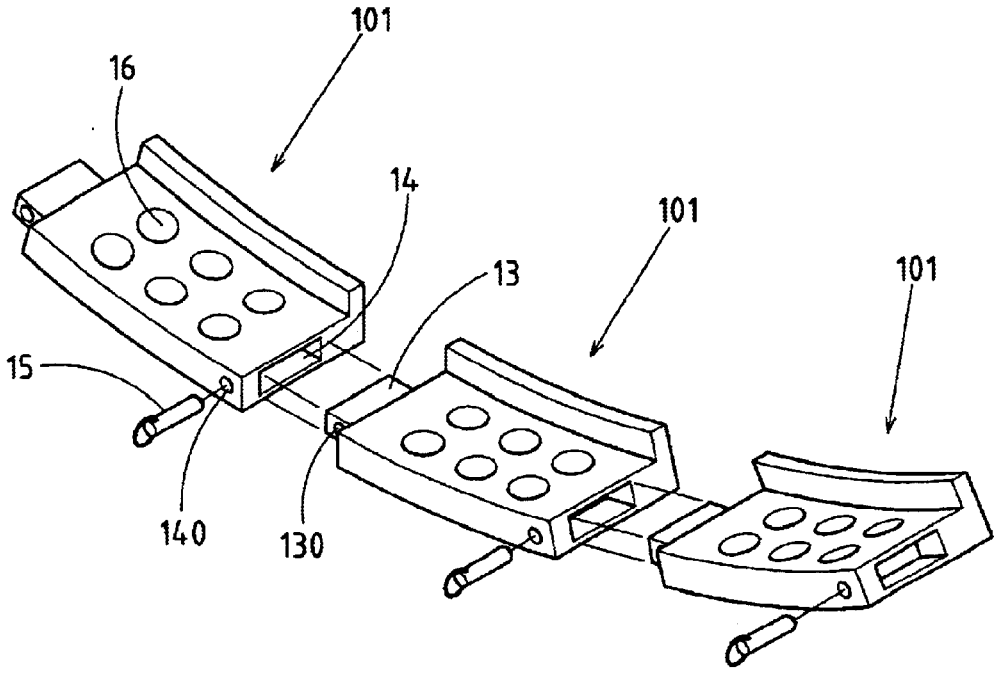
FIG. 6 shows an exploded perspective view of a third preferred embodiment of the present invention.

As shown in FIG. 6, the arcuate track of the present invention is formed of a plurality of arcuate segments 101, each being provided with a guide wall and a series of locating holes 16. The arcuate segments 101 are joined together end to end to form the arcuate track 102. The joining of the arcuate segment and a mortise 14 of one end of another segment, as shown in FIG. 6. The tenon 13 is held securely in the mortise 14 in conjunction with a pin 15 which is retained in a hole 130 of the tenon 13 via a through hole 140 of the mortise 14.

Figure 10:
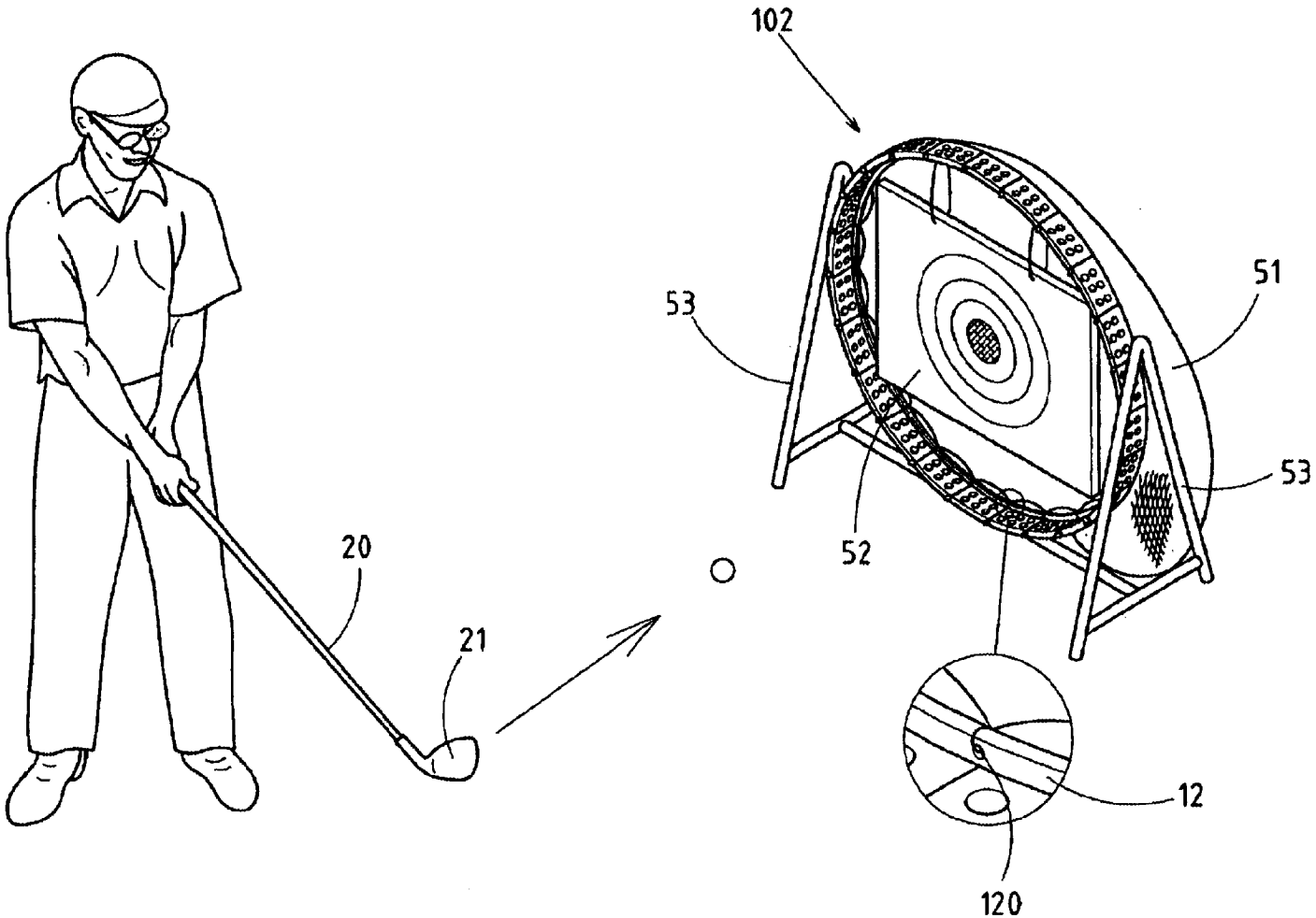
FIG. 10 shows a schematic view of a fifth preferred embodiment of the present invention at work.

The present invention is versatile, as illustrated in FIG. 10 in which a circular track 102 of the present invention is used to hold a ball trap 51 and a target 52. The circular track 102 is mounted on a frame 53. The ball trap 51 and the target 52 are fastened with the circular track 102 by cords which are put through holes 120 of the guide wall 12 of the track.

I claim:

1. A golf training device comprising:

an arcuate track having a length, said arcuate track having a series of locating holes extending therethrough;

a defining piece having a body and a pair of projections extending from an underside thereof, said pair of projections selectively received in a respective pair of locating holes of said series of locating holes, said defining piece having an abutment member extending outwardly therefrom and beyond a side of said arcuate track; and a support frame connected to said arcuate track so as to support said arcuate track at a desired angle.

2. The device of claim 1, said support frame comprising:

a base; and a rod telescopically received by said base, said rod extending so as to adjust the angle at which said arcuate track is supported.

* * * * *